United States Patent [19]

Brankling et al.

[11] 4,194,057

[45] Mar. 18, 1980

[54] POLYMER COMPOSITION VISCOSITY INDEX IMPROVER ADDITIVE AND LUBRICATING OIL CONTAINING THE ADDITIVE

[75] Inventors: David Brankling, Hull; John Crawford, Hornsea, both of England

[73] Assignee: Orobis Limited, London, England

[21] Appl. No.: 906,992

[22] Filed: May 17, 1978

[30] Foreign Application Priority Data

May 19, 1977 [GB] United Kingdom ..... 21109/77
Jul. 13, 1977 [GB] United Kingdom ..... 29406/77

[51] Int. Cl.[2] ..... C10M 1/16
[52] U.S. Cl. ..... 585/11; 585/12; 585/13
[58] Field of Search ..... 252/59; 585/11, 12, 585/13

[56] References Cited

U.S. PATENT DOCUMENTS

| | | | |
|---|---|---|---|
| 3,697,429 | 10/1972 | Engel et al. | 252/59 |
| 3,772,196 | 11/1973 | St. Clair et al. | 252/59 X |
| 3,775,329 | 11/1973 | Eckert | 252/59 |

FOREIGN PATENT DOCUMENTS 1061242 3/1967 United Kingdom .

*Primary Examiner*—W. J. Shine
*Attorney, Agent, or Firm*—Brooks, Haidt, Haffner & Delahunty

[57] ABSTRACT

A viscosity index improver additive composition contains, as one component, a vinyl aromatic/conjugated diene polymer of specific structure and composition and, as a second component an ethylene/$C_3$ to $C_{18}$ alpha olefin copolymer of specific composition and viscosity. Preferably the composition also contains a polybutene of defined molecular weight.

18 Claims, No Drawings

POLYMER COMPOSITION VISCOSITY INDEX IMPROVER ADDITIVE AND LUBRICATING OIL CONTAINING THE ADDITIVE

The present invention relates to polymer compositions suitable for use as viscosity index improver additives in finished lubricating oil compositions.

Lubricating oils are normally classified in terms of their viscosity at some standard temperature but equally important is a property known as the viscosity index, which is an empirical number giving a measure of the extent to which the viscosity of an oil decreases as the temperature is raised. An oil which satisfies viscosity requirements at both extremes of the temperature range to which it may be subjected is said to have a high "viscosity index". This property can be controlled to some extent by refining, but in recent years the trend has been towards 'multi-grade' oils, of extremely high viscosity index, in which certain polymer compounds which function as viscosity index improvers are added.

Recently, there has been developed a range of effective viscosity index improving agents for lubricating compositions based upon hydrogenated alkenylarene/-conjugated diene interpolymers. Most attention appears to have been directed to the random copolymers of an alkenylarene and a conjugated diene, though U.S. Pat. No. 3,775,329 is concerned with the use of hydrogenated tapered copolymers of isoprene and a monovinyl aromatic compound and U.S. Pat. Nos. 3,668,125; 3,763,044 and 3,668,125 are concerned with hydrogenated block copolymers of a diene and an alkenyl arene. A problem commonly encountered with tapered and block hydrogenated alkenyl arene/diene copolymers is their insolubility in lubricating oils at ambient temperatures. Thus whilst it is possible to dissolve the copolymers at elevated temperatures in hydrocarbon oils the rapid increase of viscosity with increasing concentration tends to limit their use to dilute solutions because of the practical difficulties attending the handling of highly viscous solutions. It is possible to dissolve up to and beyond 10% by weight of the copolymer in solvent neutral oils at elevated temperatures but on cooling to ambient temperatures such solutions tend to gel. This is particularly a problem for the additive manufacturer who normally markets concentrates in which the diluent is present, for economic operation, in the minimum amount consistent with compatibility. The difficulties encountered during the formulation of certain lubricating compositions containing these hydrogenated copolymers have been enumerated in U.S. Pat. Nos. 3,630,905; 3,772,169 and 3,994,815 each of which propose methods for overcoming the problem. In particular U.S. Pat. No. 3,772,169 describes the prevention of the gelling tendency by the incorporation of small amounts of a polyester of an olefinically unsaturated acid in the oil solution and U.S. Pat. No. 3,994,815 describes the initial preparation of a concentrate using a non-ester type synthetic lubricating oil diluent or carrier eg of the alkylated aromatic type, the polyolefin type, the chlorofluorocarbon type and the polyphenyl ether type, in which the copolymer is more soluble.

U.S. Pat. No. 4,081,390 describes another approach to the problem whereby from 5 to 45% of a polybutene having a number average molecular weight in the range 5,000 to 60,000 is incorporated in a solvent neutral base oil solution of a vinyl aromatic/isoprene sequential block copolymer having a number average molecular weight in the range 25,000 to 125,000 and containing from 10 to 40% by weight of the vinyl aromatic component, for the purpose of lowering the viscosity thereof.

It has now been found that the same effect may be achieved by incorporating in the tapered or block vinyl aromatic/isoprene copolymer solution in a hydrocarbon oil a specific copolymer of ethylene with one or more other specific olefins and, optionally, other particular mono- and/or di-olefins eg ethylene/-propylene/1,4-hexadiene terpolymers. This finding is surprising in view of the recognised tendency towards mutual incompatibility of mixtures of two or more high molecular weight polymers.

Thus according to the present invention there is provided a polymer composition suitable for use as a viscosity index improver additive which composition comprises, as one component, from 0.1 to 15% by weight of a sequential tapered or block copolymer comprising from 10 to 40% by weight of units derived from a vinylaromatic monomer and from 90 to 60% by weight of units derived from isoprene which copolymer has a number average molecular weight in the range 25,000 to about 125,000, as a second component, from 0.1 to 20% by weight of an oil-soluble copolymer comprising from 25 to 75% by weight of units derived from ethylene and from 75 to 25% by weight of units derived from a terminally unsaturated straight-chain mono-olefin having from 3 to 14 carbon atoms, which copolymer has a kinematic viscosity, as measured on a 5.0% by weight solution in 150 solvent neutral base oil at 210° F., greater than 100 cS and, as a third component, comprising the remainder of the composition, a mineral oil.

The terms sequential and tapered block copolymers are well known in the art but for the sake of clarity the terms will hereinafter be further elucidated. Thus a sequential block copolymer is one in which the respective monomers are present in the individual copolymer chains in distinct, substantially pure, homopolymeric blocks. Sequential tapered copolymers are essentially similar except that the individual homopolymeric blocks are not quite so pure. Thus if A represents a vinyl aromatic monomer unit and B a diene monomer unit the sequential block copolymers encompassed by the present invention have the chain structure:

A-A-A-A-A-A-A-A-B-B-B-B-B-B-B-B-B-B-B-B (a)

A-A-A-A-B-B-B-B-B-B-B-B-B-B-B-B-B-A-A-A-A (b)

A sequential tapered copolymer has the chain structure:

A A A A B B B B B B B B A B B A A B A A (c)

A A A B A A A B B A B B B B B B B B B B (d)

The invention does not include copolymers known in the art as statistical or alternating copolymers having the chain structure:

A-B-A-B-A-B-A-B-A-B-A-B-A-B-A-B (e)

Neither does the invention include random copolymers having the chain structure of the type:

A-B-B-A-A-A-B-A-B-B-A-A-A-B-A-B-B (f)

Vinyl aromatic/diene sequential block copolymers may be prepared by techniques well known in the art. Generally the known techniques involve anionic polymerisation and in particular that technique generally referred to as 'living polymerisation' in which a polymerisation initiator is added to a vinyl aromatic monomer under conditions such that the polymer chains so-formed are not terminated or are 'living' in the sense that they will initiate the polymerisation of a further batch of monomer, eg isoprene thereby resulting in the formation of a homopolyisoprene block. The sequential addition of further batches of vinyl aromatic and diene monomers may be continued until such time as the growth of the polymeric chains is arrested by, for example, the addition of a chain terminating agent. A commonly used polymerisation initiator is an organolithium compound eg n- or sec-butyl lithium. Using the anionic polymerisation technique the composition and molecular weight of a sequential block copolymer may be strictly controlled. The preparation of vinyl aromatic/diene block copolymers is described in more detail in U.S. Pat. Nos. 3,668,125 and 3,763,044. Tapered block copolymers having the chain structure (c) may be prepared by a modification of the aforedescribed method in which a mixture of the vinyl aromatic monomer and the isoprene monomer is added to the non-terminated vinyl aromatic polymer chains resulting from the initial addition of the initiator. Tapered block copolymers having the chain structure (d) may be prepared simply by adding the polymerisation initiator to a mixture of the vinyl aromatic and isoprene monomers. The production of tapered copolymers is described in more detail in U.S. Pat. No. 3,775,329.

Preferably the vinylaromatic/isoprene sequential tapered or block copolymer contains from 15 to 35, even more preferably from 20 to 30% by weight of units derived from a vinyl aromatic monomer and from 85 to 65, even more preferably from 80 to 70%, by weight of units derived from isoprene. The vinyl aromatic polymer unit in the tapered or block copolymer may be derived from styrene, an alkylated styrene or a vinyl naphthalene. Preferably the vinyl aromatic polymer unit is derived from styrene.

Preferably the number average molecular weight of the tapered or block copolymer is in the range from 50,000 to 100,000.

Preferably the vinyl aromatic/isoprene copolymers are hydrogenated in order to improve their thermal stability. Suitable methods of hydrogenation are described in U.S. Pat. Nos. 3,113,986 and 3,205,278 in which there is employed as catalyst an organotransition metal compound and trialkylaluminium (eg nickel acetylacetone or octoate and triethyl or triisobutyl aluminium). The processes described allow more than 95% of the olefinic double bonds and less than 5% of the aromatic nucleus double bonds to be hydrogenated. Alternatively the method described in U.S. Pat. No. 2,864,809 employing a nickel or kieselguhr catalyst may be employed. After hydrogenation the catalyst may be removed by treating the hydrogenated copolymer with a mixture of methanol and hydrochloric acid. The solution so-obtained is decanted, washed with water and dried by passage through a column containing a drying agent.

Preferably the vinyl aromatic/diene copolymer is Shellvis 50 marketed by Shell Chemicals. Shellvis 50 is a hydrogenated styrene/isoprene sequential block copolymer of number average molecular weight in the range 50,000 to 100,000 and contains about 75% isoprene and 25% styrene, greater than 95% of the isoprene polymer component being present in the 1,4-form in which greater than 95% of the olefinic double bonds are hydrogenated and the styrene polymer component having less than 5% of the aromatic nucleus double bonds hydrogenated.

The second component of the composition is an oil-soluble copolymer comprising from 25 to 75% by weight of units derived from ethylene and from 75 to 25% by weight of units derived from a terminally unsaturated straight-chain mono-olefin having from 3 to 14 carbon atoms, which copolymer has a kinematic viscosity, as measured on a 5.0% by weight solution in 150 solvent neutral base oil at 210° F., greater than 100 cS. Preferably the oil-soluble copolymer contains from 25 to 65%, even more preferably from 25 to 55%, by weight of units derived from ethylene and from 75 to 35, even more preferably from 75 to 45%, by weight of the terminally unsaturated straight-chain mono-olefin. Suitable terminally unsaturated straight-chain mono-olefins having from 3 to 14 carbon atoms include propylene, 1-butene, 1-pentene, 1-hexene, 1-heptene, 1-octene, 1-nonene, 1-decene and mixed alkenes having 12 to 14 carbon atoms. Preferably the straight-chain mono-olefin is propylene. Preferably the oil-soluble copolymer additionally contains units derived from one or more comonomers selected from (a) norbornene, (b) terminally unsaturated non-conjugated diolefins having from 5 to 8 carbon atoms, (c) dicyclopentadiene and (d) 5-methylene-2-norbornene. Suitable terminally unsaturated non-conjugated diolefins having from 5 to 8 carbon atoms include 1,4-pentadiene, 1,4-hexadiene, 1,5-hexadiene, 2-methyl-1,5-hexadiene, 1,6-heptadiene and 1,7-octadiene. Preferably the diolefin is 1,4-hexadiene. Preferably the olefin copolymer contains no more than 10% by weight of units derived from one or more of the comonomers (a), (b), (c) and (d).

Preferably the kinematic viscosity, as measured on a 5.0% by weight solution in 150 solvent neutral base oil at 210° F., of the oil-soluble copolymer is not greater than 1500 cS. The preferred copolymers have a kinematic viscosity in the range of from 100 to 500 cS. Kinematic viscosity is defined in the Handbook of Chemistry and Physics, 44th Edition, page 2251 as the ratio of viscosity to density, the cgs unit of kinematic viscosity being the stoke (≡100 Centistokes). Kinematic viscosity is indicative of the molecular weight of the polymer. Generally the weight average molecular weight of the ethylene copolymers will be in the range 40,000 to 150,000. Preferably the molecular weight distribution, as determined by dividing the weight average molecular weight by the number average molecular weight, is less than 8, even more preferably less than 5.

Commercially available ethylene copolymers which may be used to advantage in the composition of the present invention are the Intolan range of solution polymerised copolymers which comprise units derived from either ethylene and propylene or ethylene, propylene and 5-methylene-2-norbornene or dicyclopentadiene, manufactured by International Synthetic Rubber and the Nordel range of copolymers which comprise units derived from ethylene, propylene and 1,4-hexadiene, manufactured by E. I. du Pont de Nemours and Company. The preferred Intolan copolymer is Intolan 140A which is an ethylene/propylene/5-methylene-2-norbornene terpolymer in which the ethylene/propylene ratio is about 60:40 by weight is about 88,000, the number average molecular weight, the 5-methylene-2-norbornene content is about 5.7% by weight, the weight average molecular weight is about 31,000 and the kinematic viscosity is about 280 cS. The preferred Nordel copolymer is Nordel 1320 which is an ethylene/propylene/1,4-hexadiene terpolymer in which the ethylene/propylene ratio is about 45:55, the 1,4-hexadiene content is about 2 to 3% by weight and the kinematic viscosity is about 204 cS. A viscosity index improver grade of Nordel 1320, known as Ortholeum 2035, is available. Other commercially available ethylene copolymers which may be used in the compositions of the present invention include Royalene (Uniroyal) and Vistalon (Esso Chemicals) copolymers.

Methods for preparing oil-soluble ethylene copolymers are well-known in the art. Representative of such art is the book entitled "Linear and Stereoregular Addition Polymers" by Gaylord and Mark, published by Interscience Publishers, New York, N.Y. 1959. U.S. Pat. Nos. 2,799,688; 2,975,159; 2,933,480; 3,598,738 and 3,691,142 and Canadian Pat. No. 85,574 are also representative of such art. Typical co-ordination catalysts which may be used in the preparation of the copolymers are hydrocarbon-soluble vanadium compounds in conjunction with organoaluminium compounds. Examples of soluble vanadium compounds which may be used are vanadium oxytrichloride, vanadium tetrachloride and vanadium trisacetylacetonate. Aluminium compounds which may be used include aluminium alkyls such as aluminium triethyl and alkylaluminium halides such as disobutylaluminium monochloride. Either the vanadium or the aluminium compound, or both, preferably contain(s) halogen. In using such catalysts suitable aluminium to vanadium ratios and amounts of catalyst employed per liter of solution will depend on the specific compounds and conditions employed. These are well-known to those skilled in the art. Generally, aluminium to vanadium ratios may fall within the range from 2:1 to 20:1. Likewise, the amount of catalyst, expressed as the amount of vanadium content frequently ranges from $1.0\times10^{-5}$ to $2.0\times10^{-3}$ moles per liter. Frequently compounds which enhance the activity of the co-ordination catalysts are incorporated. Examples of such compounds are benzotrichloride and hexachloropropene. When these compounds are incorporated in the catalyst the aluminium to vanadium ratio may be greatly increased and the vanadium concentration greatly reduced. Such an effect is demonstrated in U.S. Pat. Nos. 3,072,630; 3,328,366 and 3,301,834.

The polymerisation is normally carried out at ordinary temperatures and pressures, although it is usually convenient to allow the temperature to rise spontaneously to about 50° to 60° C. due to the heat of the reaction. Although elevated temperatures and pressures are not required, the rate of the reaction may be increased by the use of increased pressures up to, for example, 100 atmospheres or above, or increased temperatures up to about 150° C. On the other hand, if desired, the polymerisation may also be carried out at reduced temperatures and pressures. The conditions are preferably chosen to give a polymer having a narrow molecular weight distribution.

The third component of the composition of the invention is a mineral oil which is preferably a solvent neutral base oil. Suitable solvent neutral base oils include 85 to 300 solvent neutral base oils. A preferred solvent neutral base oil is a 130 to 150 solvent neutral base oil. Such oils are generally nonvolatile mineral oils which have been refined, generally by solvent extraction, to remove acidic and alkaline components. The mineral oil may be derived from paraffinic or naphthenic base petroleum, shale oil or the like.

Preferably the polymer compositions of the present invention additionally contain a fourth component which comprises a polybutene having a number average molecular weight in the range of from 5000 to 60,000. The polybutene may form from 1 to 50% by weight of the composition.

Polybutenes may be prepared by continuously feeding a refinery butane/butene stream containing butanes, isobutylene, butenes and minor concentrations of $C_3$ and $C_5$ hydrocarbons into a cylindrical agitated reactor maintained at about −10° C. and 100 psig in the presence of aluminium chloride as catalyst. The polybutenes in the reactor effluent may be recovered and purified in a series of operations consisting of quenching of the catalyst, washing, settling, filtering, flashing and stripping. A product within a range of molecular weight distribution may be fractionated and the fractions recombined to form various grades of polybutenes. A method and apparatus for preparing polybutenes are described in Cosden's British Patent Specification No. 933,340.

Preferably the polybutene forming the third component of the composition is a commercially available polybutene marketed by BP Chemicals Limited. A suitable polybutene is Hyvis 7000/45, which is a solution in 150 solvent neutral base oil of a polybutene having a number average molecular weight in the range 30,000 to 42,000, the polybutene forming 45% by weight of the solution. Another suitable polybutene is Hyvis 2000 which is a polybutene having a number average molecular weight of about 5,800, a weight average molecular weight of about 21,000 and a viscosity average molecular weight of about 17,000.

A preferred polymer composition according to the present invention contains from 0.1 to 10% by weight of the vinyl aromatic/isoprene copolymer, from 0.1 to 10% of the oil-soluble copolymer and, comprising the remainder of the composition, a solvent neutral base oil.

An even more preferred polymer composition contains from 0.5 to 10% by weight of the vinyl aromatic/isoprene copolymer, from 1 to 10% by weight of the oil-soluble ethylene copolymer, from 2 to 35% by weight of the polyisobutene and, comprising the remainder of the composition, a solvent neutral base oil.

The composition may suitably be prepared by mixing the components. Whilst the order in which the components are mixed is not critical it is preferred to dissolve first of all the oil-soluble ethylene copolymer and, where appropriate, the polybutene in the oil and thereafter dissolve the vinyl aromatic/diene block copolymer in the solution so-formed. Dissolution of the components in the oil may be aided by milling or shredding the copolymers prior to mixing, the use of elevated temperatures and, during mixing agitation of the composition, suitably by stirring. Furthermore mixing may be effected in an atmosphere of an inert gas such as nitrogen. The elevated temperature may be in the range 50 to 220, preferably 75 to 200, even more preferably 120° to 180° C.

The composition may be used in the compounding of finished lubricant compositions.

Thus according to another aspect of the present invention there is provided a finished lubricant composition comprising a major proportion of a lubricant base oil and a minor proportion of the polymer composition as hereinbefore described.

The polymer composition may be incorporated in the lubricant base oil in an amount of from 0.5 to 25, preferably from 1 to 15% by weight.

The lubricant base oil is preferably a crank case oil, which is generally a preponderantly paraffinic, solvent refined neutral oil having a Saybolt Universal Second (SUS) viscosity of about 60 to 220 at 100° F. and a viscosity index of about 80 to 110. Alternatively the lubricant base oil may be a transmission fluid base oil.

Conventional additives may be incorporated either in the viscosity index improver additive polymer composition or directly in the finished lubricant compositions. Such additives include detergents, dispersants, corrosion inhibitors, antioxidants, extreme pressure agents, anti-wear agents etc.

The invention will now be illustrated by reference to the following Examples.

COMPARISON TEST 1 (not according to the invention)

Increasing amounts of Shellvis 50* were dissolved in LP501** mineral oil and their kinematic viscosity at 210° F. was measured. The results of the viscosity measurements are given in Table 1.

*Shellvis 50 is a hydrogenated styrene/isoprene copolymer containing about 25% by weight styrene and 75% by weight isoprene and having an Mn in the range 50,000 to 100,000. The isoprene component is greater than 95% in the 1,4-form and the olefinic double bonds are greater than 95% hydrogenated. Shellvis 50 is commercially available from Shell Chemicals Limited.

**LP501 is a 150 solvent neutral base oil.

TABLE 1

| Concn. of Shellvis 50 in LP 501 (% by weight) | Kinematic Viscosity at 210° F. (cs) |
|---|---|
| 5 | 900 |
| 5.6 | 1320*** |
| 6.0 | Jelly, viscosity not measurable |
| 7.5 | Jelly-like fluid - viscosity not measurable at any temperature |

***Viscosity measured at 215° F.

EXAMPLE 1

7.5% by weight Shellvis 50 was dissolved in a solution of 2.5% by weight Nordel**** N.2722 in LP 501 and its kinematic viscosity at 210° F. measured. The value of the viscosity is given in Table 2.

****Nordel products are copolymers containing, for the most part ethylene and propylene and to a lesser extent 1,4-hexadiene. The Nordel copolymers vary principally in molecular weight and the relative proportions of the components. They are manufactured by E. I. du Pont de Nemours and Company.

EXAMPLE 2

7.5% by weight Shellvis 50 was dissolved in a solution of 2.5% by weight Nordel N.1320 in LP 501 and its kinematic viscosity at 210° F. measured. The value of the viscosity is given in Table 2.

EXAMPLE 3

7.5% by weight Shellvis 50 was dissolved in a solution of 2.0% by weight Nordel N.1635 in LP 501 and its kinematic viscosity at 210° F. measured. The value of the viscosity is given in Table 2.

EXAMPLE 4

7.5% by weight Shellvis 50 was dissolved in a solution of 2.0% by weight Nordel N.1560 in LP 501 and its kinematic viscosity at 210° F. measured. The value of the viscosity is given in Table 2.

EXAMPLE 5

7.5% by weight Shellvis 50 was dissolved in a solution of 1.0% by weight Nordel N.1560 in LP 501 and its kinematic viscosity at 210° F. measured. The value of the viscosity is given in Table 2.

EXAMPLE 6

7.5% by weight Shellvis 50 was dissolved in a solution of 0.5% by weight Nordel N.1070 in LP 501 and its kinematic viscosity at 210° F. measured. The value of the viscosity is given in Table 2.

EXAMPLE 7

7.5% by weight Shellvis 50 was dissolved in a solution of 2.0% by weight Nordel N.1070 in LP 501 and its kinematic viscosity at 210° F. measured. The value of the viscosity is given in Table 2.

TABLE 2

| Example | Kinematic Viscosity at 210° F. (cs) |
|---|---|
| 1 | 2560 |
| 2 | 1890 |
| 3 | 3200 |
| 4 | 6360 |
| 5 | 6520 |
| 6 | 5370 |
| 7 | 7670 |

EXAMPLE 8

5.0% by weight of Shellvis 50 was dissolved in a 5% by weight solution of Nordel 2722 in LP 501 oil and the kinematic viscosity of the solution at 210° F. measured. The result of the viscosity measurement is given in Table 3.

EXAMPLE 9

5.0% by weight of Shellvis 50 was dissolved in a 5% by weight solution of Nordel 1560 in LP 501 oil and the kinematic viscosity of the solution at 210° F. measured. The result of the viscosity measurement is given in Table 3.

EXAMPLE 10

5.0% by weight of Shellvis 50 was dissolved in a 5% by weight solution of Nordel 1320 in LP 501 oil and the kinematic viscosity of the solution at 210° F. measured. The result of the viscosity measurement is given in Table 3.

EXAMPLE 11

5.0% by weight of Shellvis 50 was dissolved in a 5% by weight solution of Nordel 1635 in LP 501 oil and the kinematic viscosity of the solution at 210° F. measured. The result of the viscosity measurement is given in Table 3.

COMPARISON TESTS 2 to 5 (not according to the invention)

The kinematic viscosity of 5.0% by weight solutions of the Nordel copolymers as used in Examples 8 to 11 in LP 501 oil was measured. The results of the viscosity measurements are given in Table 3.

TABLE 3

| Example | Composition | Viscosity (cs) |
|---|---|---|
| Comparison Test 1 | 5% Shellvis 50 in LP 501 | 900 |
| Comparison Test 2 | 5% Nordel 2722 in LP 501 | 137 |
| 8 | 5% Nordel 2722 in LP 501 + 5% Shellvis 50 | 1280 |
| Comparison Test 2 | 5% Nordel 1560 in LP 501 | 1314 |
| 9 | 5% Nordel 1560 in LP 501 + 5% Shellvis 50 | 15430 |
| Comparison Test 2 | 5% Nordel 1320 in LP 501 | 204 |
| 10 | 5% Nordel 1320 in LP 501 + 5% Shellvis 50 | 1470 |
| Comparison Test 2 | 5% Nordel 1635 in LP 501 | 260 |
| 11 | 5% Nordel 1635 in LP 501 + 5% Shellvis 50 | 2250 |

EXAMPLE 12

5.0% by weight Shellvis 50 was dissolved in a 5.0% by weight solution of Royalene 400 in LP 501 oil and the kinematic viscosity of the solution at 210° F. measured. The result of the viscosity measurement is given in Table 4. The Royalene products are ethylene/-propylene/diene copolymers manufactured in the USA by Uniroyal.

EXAMPLE 13

5.0% by weight Shellvis 50 was dissolved in a 5.0% by weight solution of Royalene 502 in LP 501 oil and the kinematic viscosity of the solution at 210° F. measured. The result of the viscosity measurement is given in Table 4.

EXAMPLE 14

5.0% by weight Shellvis 50 was dissolved in a 5.0% by weight solution of Intolan 140A, an ethylene/propylene diene copolymer, in LP 501 oil and the kinematic viscosity of the solution at 210° F. measured. The result of the viscosity measurement is given in Table 4.

EXAMPLE 15

5.0% by weight Shellvis 50 was dissolved in a 5.0% by weight solution of Vistalon 2504, an ethylene/propylene diene copolymer supplied by Esso Chemicals, in LP 501 oil and the kinematic viscosity of the solution at 210° F. measured. The result of the viscosity measurement is given in Table 4.

COMPARISON TESTS 6 TO 9

The viscosity of 5.0% by weight solutions of the copolymers used in Examples 12 to 15 was measured. The results of the kinematic viscosity measurement are given in Table 4.

TABLE 4

| Example | Composition | Viscosity (cs) |
|---|---|---|
| Comparison Test 6 | 5% Royalene 400 in LP501 | 220 |
| Example 12 | 5% Royalene 400 in LP501 + 5% Shellvis 50 | 3100 |
| Comparison Test 7 | 5% Royalene 502 in LP501 | 490 |
| Example 13 | 5% Royalene 502 in LP 501 + 5% Shellvis 50 | 2700 |
| Comparison Test 8 | 5% Intolan 140A in LP501 | 280 |
| Example 14 | 5% Intolan 140A in LP501 + 5% Shellvis 50 | 2400 |
| Comparison Test 9 | 5% Vistalon 2504 in LP501 | 300 |
| Example 15 | 5% Vistalon 2504 in LP501 + 5% Shellvis 50 | 1900 |
| Comparison Test 1 | 5% Shellvis 50 in LP501 | 900 |

COMPARISON TEST 10

Into 100 solvent neutral base oil was dissolved Shellvis 50 and Hyvis 7000/45***** to provide a composition containing 7.0% by weight Shellvis 50 and 10% by weight Hyvis 7000/45. The kinematic viscosity at 210° F. of the solution was measured and its value is given in Table 5.

*****Hyvis 7000/45 is a solution of a polybutene having an Mn in the range 30,000 to 42,000 in 150 solvent neutral (SN) base oil, the polybutene forming 45% by weight of the solution.

EXAMPLE 16

Nordel 1320 was dissolved in an aliquot of the solution of Comparison Test 10 to give a solution containing 99.5% by weight Shellvis 50/Hyvis 7000/45/100SN base oil having the composition given in Comparison Test 10, and 0.5% by weight Nordel 1320. The kinematic viscosity at 210° F. of the solution was measured and its value is given in Table 5.

EXAMPLE 17

Example 16 was repeated except that the concentration of Nordel 1320 in the solution was increased to 1.0% by weight.

EXAMPLE 18

Example 16 was repeated except that the concentration of Nordel 1320 in the solution was increased to 2.0% by weight.

EXAMPLES 19 TO 21

Examples 16, 17 and 18 were repeated with the Nordel 1320 replaced by Intolan 140A.

TABLE 5

| Example No. | Composition | Viscosity at 210° F. (cS) |
|---|---|---|
| Comp. Test 10 | 7.0% b.w. Shellvis 50 + 10% b.w. Hyvis 7000/45 + remainder 100SN base oil. | 7440 |
| Example 16 | 99.5% b.w. solution of Comp. Test 2 + 0.5% b.w. Nordel 1320. | 1422 |
| Example 17 | 99.0% b.w. solution of Comp. Test 2 + 1.0% b.w. Nordel 1320. | 1340 |
| Example 18 | 98.0% b.w. solution of Comp. Test 2 + 2.0% b.w. Nordel 1320. | 1467 |
| Example 19 | 99.5% b.w. solution of Comp. Test 2 + 0.5% b.w. Intolan 140A. | 1504 |
| Example 20 | 99.0% b.w. solution of Comp. Test 2 + 1.0% b.w. Intolan 140A. | 1320 |

TABLE 5-continued

| Example No. | Composition | Viscosity at 210° F. (cS) |
|---|---|---|
| Example 21 | 98.0% b.w. solution of Comp. Test 2 + 2.0% b.w. Intolan 140A. | 1583 |
| Comp. Test 2 | 5% Nordel 1320 in LP501 | 204 |
| | Hyvis 7000/45 | 1000 |

Hyvis 7000/45 is a solution of a polybutene having an mn in the range 30,000 to 42,000 in 150 solvent neutral (SN) base oil, the polybutene forming 45% by weight of the solution.

EXAMPLES 22 TO 27

Solutions having the compositions shown in Table 6 were made up and their viscosities at 210° F. measured. The results of the viscosity measurements are also given in Table 6.

TABLE 6

| Example | Composition | Viscosity (cS) |
|---|---|---|
| 22 | 7.5% b.w. Shellvis 50 + 1.0% b.w. Nordel 1320 + 15% b.w. Hyvis 7000/45 + 130SN base oil. | 1785 |
| 23 | 7.5% b.w. Shellvis 50 + 2.0% b.w. Nordel 1320 + 15% b.w. Hyvis 7000/45 + 130SN base oil. | 2337 |
| 24 | 7.5% b.w. Shellvis 50 + 1.5% b.w. Nordel 1320 + 15% b.w. Hyvis 7000/45 + 130SN base oil. | 1722 |
| 25 | 7.5% b.w. Shellvis 50 + 1.0% b.w. Nordel 1320 + 25% b.w. Hyvis 7000/45 + 130SN base oil. | 1922 |
| 26 | 7.5% b.w. Shellvis 50 + 0.6% b.w. Nordel 1320 + 15% Hyvis 7000/45 + 130SN base oil. | 1625 |
| 27 | 6.5% b.w. Shellvis 50 + 4.0% b.w. Nordel 1320 + 10% Hyvis 7000/45 + 100SN base oil. | 2270 |

EXAMPLES 28 TO 34

Solutions having the compositions shown in Table 7 were made up and their viscosities at 210° F. measured. The results of the viscosity measurements are also given in Table 7.

TABLE 7

| Example | Composition | Viscosity (cS) |
|---|---|---|
| 28 | 0.75% b.w. Shellvis 50 + 4% b.w. Ortholeum 2035 + 56% b.w. Hyvis 7000/45 + 180 solvent neutral base oil. | 1588 |
| 29 | 0.6% b.w. Shellvis 50 + 4.0% b.w. Ortholeum 2035 + 56% b.w. Hyvis 7000/45 + 100 solvent neutral base oil. | 1193 |
| 30 | 0.8% b.w. Shellvis 50 + 4.0% b.w. Ortholeum 2035 + 56% b.w. Hyvis 7000/45 + 100 solvent neutral base oil. | 1187 |
| 31 | 0.6% b.w. Shellvis 50 + 3.5% b.w. Ortholeum 2035 + 60% b.w. Hyvis 7000/45 + 100 solvent neutral base oil. | 1310 |
| 32 | 0.8% b.w. Shellvis 50 + 3.5% b.w. Ortholeum 2035 + 60% b.w. Hyvis 7000/45 + 100 solvent neutral base oil | 1058 |
| 33 | 0.6% b.w. Shellvis 50 + 3.5% b.w. Ortholeum 2035 + 62% b.w. Hyvis 7000/45 + 100 solvent neutral base oil | 1186 |
| 34 | 0.6% b.w. Shellvis 50 + 3.5% b.w. Ortholeum 2035 + 64% b.w. Hyvis 7000/45 + 100 solvent neutral base oil | 1265 |

EXAMPLES 35 TO 44

A solution containing 60% by weight Hyvis 2000 and 40% by weight LP 501 was prepared by dissolving Hyvis 2000 in the LP 501.

Hyvis 2000 is a polybutene characterised as follows:

Number Average Molecular Weight=5,800

Weight Average Molecular Weight=21,000

Viscosity Average Molecular Weight=17,000

Solutions having the composition shown in Table 8 were made up and their viscosities at 210° F. were measured. The results of the viscosity measurements are also given in Table 8.

TABLE 8

| Example | Shellvis 50 (wt %) | Ortholeum 2053 (wt %) | Solution of 60% by wt Hyvis 2000 in 40% by weight LP 501 (wt %) | 100 solvent neutral oil (wt %) | Viscosity at 210° F. (cS) |
|---|---|---|---|---|---|
| 35 | 7 | 2 | 20 | 71 | 1728 |
| 36 | 7 | 2 | 15 | 76 | 1095 |
| 37 | 7 | 2 | 17 | 74 | 1321 |
| 38 | 7 | 2 | 16 | 75 | 1217 |
| 39 | 6 | 3 | 16 | 75 | 1420 |
| 40 | 6 | 3 | 15 | 76 | 1527 |
| 41 | 5 | 4 | 20 | 71 | 1710 |
| 42 | 6 | 3 | 17 | 74 | 1346 |
| 43 | 5 | 3 | 16 | 76 | 954 |
| 44 | 5 | 3 | 17 | 75 | 1054 |

We claim:

1. A polymer composition suitable for use as a viscosity index improver additive which composition comprises as essential components:

(A) from 0.1 to 15% by weight of a tapered or block copolymer consisting of from 10 to 40% by weight of units derived from styrene and from 90 to 60% by weight of units derived from isoprene, said copolymer having a number average molecular weight in the range 25,000 to about 125,000, (B) from 0.1 to 20% by weight of an oil-soluble copolymer consisting of from 25 to 75% by weight of units derived from ethylene and from 75 to 25% by weight of units derived from propylene, said copolymer having a kinematic viscosity, as measured on a 5.0% by weight solution in 150 solvent neutral base oil at 210° F., in the range from 100 to 1500 cS, and (C) a mineral oil.

2. A composition according to claim 1 wherein said copolymer constituting component (A) contains from 15 to 35% by weight of units derived from styrene and from 85 to 65% by weight of units derived from isoprene.

3. A composition according to claim 1 wherein more than 95% of the olefinic double bonds and less than 5% of the aromatic nucleus double bonds of said copolymer constituting said component (A) are hydrogenated.

4. A composition according to claim 1 wherein said copolymer constituting said component (A) is a hydrogenated polystyrene/polyisoprene sequential block copolymer of number average molecular weight in the range 50,000 to 100,000, said copolymer containing about 75% isoprene and about 25% styrene, greater than 95% of said polyisoprene being present in the 1,4-form in which greater than 95% of the olefinic double bonds are hydrogenated and said polystyrene having less than 5% of the aromatic nucleus double bonds hydrogenated.

5. A composition according to claim 1 wherein said oil-soluble copolymer constituting said component (B) additionally contains up to 10% by weight of units derived from at least one comonomer selected from (a) norbornene, (b) terminally unsaturated nonconjugated diolefins having from 5 to 8 carbon atoms, and (c) 5-methylene-2-norbornene.

6. A composition according to claim 5 wherein said terminally unsaturated non-conjugated diolefin is 1,4-hexadiene.

7. A composition according to claim 1 wherein said copolymer constituting said component (B) has a kinematic viscosity in the range 100 to 500 cS.

8. A composition according to claim 1 wherein said oil-soluble copolymer constituting said component (B) is derived from ethylene, propylene and 5-methylene-2-norbornene.

9. A composition according to claim 1 wherein said oil-soluble copolymer constituting said component (B) is an ethylene/propylene/5-methylene-2-norbornene terpolymer in which the ethylene/propylene ratio is about 60:40 by weight, the 5-methylene-2-norbornene content is about 5.7% by weight, the weight average molecular weight is about 88,000, the number average molecular weight is about 31,000 and the kinematic viscosity is about 280 cS.

10. A composition according to claim 1 wherein said oil-soluble copolymer constituting said component (B) is derived from ethylene, propylene and 1,4-hexadiene.

11. A composition according to claim 1 wherein said oil-soluble copolymer constituting said component (B) is an ethylene/propylene/1,4-hexadiene terpolymer in which the ethylene/propylene ratio is about 45:55, the 1,4-hexadiene content is about 2 to 3% by weight and the kinematic viscosity is about 204 cS.

12. A composition according to claim 1 wherein said mineral oil constituting said component (C) is an 85 to 300 solvent neutral base oil.

13. A composition according to claim 1 which composition additionally contains as component (D) from 1 to 50% by weight of a polybutene, said polybutene having a number average molecular weight in the range from 5,000 to 60,000.

14. A composition according to claim 13 wherein said polybutene is a solution in 150 solvent neutral base oil of a polybutene having a number average molecular weight in the range 30,000 to 42,000, said polybutene forming 45% by weight of said solution.

15. A composition according to claim 13 wherein said polybutene has a number average molecular weight of about 5,800, a weight average molecular weight of about 21,000 and a viscosity average molecular weight of about 17,000.

16. A composition according to claim 1 which composition contains from 0.1 to 10% by weight of said component (A) and from 0.1 to 10% by weight of said component (B), said component (C) constituting the remainder of said composition.

17. A composition according to claim 1 which composition contains from 0.1 to 10% by weight of said component (A), from 0.1 to 10% by weight of said component (B), from 2 to 35% by weight of a polybutene having a number average molecular weight in the range from 5,000 to 60,000, said component (C) constituting the remainder of said composition.

18. A finished lubricant composition comprising a lubricant base oil and from 1 to 15% by weight of the polymer composition as claimed in claim 1, said lubricant base oil being a preponderantly paraffinic, solvent refined neutral oil having an SUS viscosity in the range from 60 to 220 at 100° F. and a viscosity index of about 80 to 110.

* * * * *